US008388807B2

(12) United States Patent
Sealey et al.

(10) Patent No.: US 8,388,807 B2
(45) Date of Patent: Mar. 5, 2013

(54) PARTIALLY FIRE RESISTANT INSULATION MATERIAL COMPRISING UNREFINED VIRGIN PULP FIBERS AND WOOD ASH FIRE RETARDANT COMPONENT

(75) Inventors: James E. Sealey, Loveland, OH (US); Brent A. Fields, Trenton, OH (US)

(73) Assignee: International Paper Company, Memphis, TN (US)

( * ) Notice: Subject to any disclaimer, the term of this patent is extended or adjusted under 35 U.S.C. 154(b) by 20 days.

(21) Appl. No.: 13/023,023

(22) Filed: Feb. 8, 2011

(65) Prior Publication Data

US 2012/0199303 A1 Aug. 9, 2012

(51) Int. Cl.
*D21H 11/00* (2006.01)

(52) U.S. Cl. ..... 162/159

(58) Field of Classification Search ..... 162/159; 442/414, 327; 428/212
See application file for complete search history.

(56) References Cited

U.S. PATENT DOCUMENTS

| | | | | |
|---|---|---|---|---|
| 1,382,618 | A | | 6/1921 | Blenio |
| 2,654,295 | A | | 10/1953 | Sutherland |
| 2,832,745 | A | | 4/1958 | Hechenblefkner |
| 2,982,482 | A | | 5/1961 | Curtis |
| 3,049,307 | A | | 8/1962 | Dalzell, Jr. |
| 3,591,450 | A | | 7/1971 | Murphy et al. |
| 3,815,834 | A | | 6/1974 | Gilbert |
| 3,900,327 | A | | 8/1975 | Miller |
| 3,955,032 | A | | 5/1976 | Mischutin |
| 3,972,092 | A | | 8/1976 | Wood |
| 4,022,965 | A | | 5/1977 | Goheen et al. |
| 4,026,808 | A | | 5/1977 | Duffy |
| 4,060,450 | A | | 11/1977 | Palazzolo et al. |
| 4,065,347 | A | | 12/1977 | Aberg et al. |
| 4,075,136 | A | | 2/1978 | Schaper |
| 4,081,316 | A | | 3/1978 | Aberg et al. |
| 4,118,531 | A | | 10/1978 | Hauser |
| 4,166,894 | A | | 9/1979 | Schaper |
| 4,168,175 | A | | 9/1979 | Shutt |
| 4,174,417 | A | | 11/1979 | Rydell |
| 4,184,969 | A | | 1/1980 | Bhat |
| 4,212,675 | A | | 7/1980 | Robinson |
| 4,425,186 | A | | 1/1984 | May et al. |
| 4,431,481 | A | | 2/1984 | Drach et al. |
| 4,496,427 | A | | 1/1985 | Davison |
| 4,595,414 | A | | 6/1986 | Shutt |
| 4,600,606 | A | | 7/1986 | Mischutin |
| 4,602,982 | A | | 7/1986 | Samuelson |
| 4,702,861 | A | | 10/1987 | Farnum |
| 4,725,382 | A | | 2/1988 | Lewchalermwong |
| 4,986,882 | A | | 1/1991 | Mackey et al. |
| 5,011,091 | A | | 4/1991 | Kopecky |
| 5,049,235 | A | | 9/1991 | Barcus et al. |
| 5,064,710 | A | | 11/1991 | Gosz |
| 5,076,969 | A | | 12/1991 | Fox |
| 5,155,964 | A | * | 10/1992 | Fortin et al. ..... 52/742.13 |
| 5,160,789 | A | | 11/1992 | Barcus et al. |
| 5,209,953 | A | | 5/1993 | Grupe et al. |
| 5,252,754 | A | | 10/1993 | Bottorff |
| 5,262,005 | A | | 11/1993 | Eriksson et al. |
| 5,266,250 | A | | 11/1993 | Kroyer |
| 5,272,852 | A | * | 12/1993 | Fortin et al. ..... 52/742.13 |
| 5,360,420 | A | | 11/1994 | Cook et al. |
| 5,405,555 | A | | 4/1995 | Riker |
| 5,443,899 | A | | 8/1995 | Barcus et al. |
| 5,491,186 | A | | 2/1996 | Kean et al. |
| 5,516,580 | A | | 5/1996 | Frenette et al. |
| 5,531,728 | A | | 7/1996 | Lash |
| 5,534,301 | A | | 7/1996 | Shutt |
| 5,554,238 | A | | 9/1996 | English |
| 5,642,601 | A | | 7/1997 | Thompson, Jr. et al. |
| 5,662,773 | A | | 9/1997 | Frederick et al. |
| 5,667,637 | A | | 9/1997 | Jewell et al. |
| 5,698,074 | A | | 12/1997 | Barcus et al. |
| 5,698,688 | A | | 12/1997 | Smith et al. |
| H1704 | H | | 1/1998 | Wallajapet et al. |
| 5,723,020 | A | | 3/1998 | Robinson et al. |
| 5,731,080 | A | | 3/1998 | Cousin et al. |
| 5,786,059 | A | | 7/1998 | Frank et al. |
| 5,858,530 | A | | 1/1999 | McCullough, Jr. |

(Continued)

FOREIGN PATENT DOCUMENTS

| | | |
|---|---|---|
| EP | 0132128 | 1/1985 |
| GB | 2209352 | 5/1989 |
| WO | 8908137 | 9/1989 |
| WO | 9304239 | 3/1993 |
| WO | 9412725 | 6/1994 |

(Continued)

OTHER PUBLICATIONS

G. A. Smook, Handbook for Pulp and Paper Technologists, 2nd edition, 1992.

Smook Handbook, p. 336 and 342,chapter 7 pp. 74 to 83, chapter 18 pp. 283 to 296, 2009.

Flame Retardants for Plastics and texiles, Weil, et al, Hanser Publishers, Munich 2009, p. 4-8, 2009.

Hydromagnesite—Mg5 (Co3) 4 (OH) 2-4H20, 2001.

Huntite—CaMg3 (Co3)4, 2001.

*Primary Examiner* — Mark Halpern

(74) *Attorney, Agent, or Firm* — Thomas W. Barnes, III; Eric W. Guttag; John K. Pike

(57) ABSTRACT

A partially fire resistant cellulosic fiber thermal insulation material from a fibrous web of unrefined virgin softwood and hardwood provides fibers which provides an R-value (as measured by the ASTM C518 test) of at least about 3, and a wood ash fire retardant component present in and/or on the fibrous web in an amount of at least about 1.5% by weight of the fibrous web and sufficient to impart at least partial fire resistance (as measured by the ASTM E970-08A test) to the fibrous web. Also, a process for preparing this at least partially fire resistant thermal insulation material.

37 Claims, 4 Drawing Sheets

U.S. PATENT DOCUMENTS

| | | | |
|---|---|---|---|
| 5,886,306 | A | 3/1999 | Patel et al. |
| 5,910,367 | A | 6/1999 | Kean et al. |
| 6,025,027 | A | 2/2000 | Shutt |
| 6,059,924 | A | 5/2000 | Hoskins |
| 6,146,494 | A | 11/2000 | Seger et al. |
| 6,162,329 | A | 12/2000 | Vinson et al. |
| 6,361,651 | B1 | 3/2002 | Sun |
| 6,372,360 | B1 | 4/2002 | Blunden et al. |
| 6,471,824 | B1 | 10/2002 | Jewell |
| 6,506,282 | B2 | 1/2003 | Hu et al. |
| 6,579,414 | B2 | 6/2003 | Jewell |
| 6,579,415 | B2 | 6/2003 | Jewell |
| 6,582,557 | B2 | 6/2003 | Jewell |
| 6,589,643 | B2 | 7/2003 | Okada et al. |
| 6,592,712 | B2 | 7/2003 | Koukoulas et al. |
| 6,592,717 | B2 | 7/2003 | Jewell |
| 6,719,862 | B2 | 4/2004 | Quick et al. |
| 6,733,697 | B2 | 5/2004 | Rhodes et al. |
| 6,867,154 | B1 | 3/2005 | Lunsford et al. |
| 6,982,049 | B1 | 1/2006 | Mabey et al. |
| 6,989,113 | B1 | 1/2006 | Mabey |
| 7,144,474 | B1 | 12/2006 | Hansen et al. |
| 7,381,300 | B2 | 6/2008 | Skaggs et al. |
| 7,549,853 | B2 | 6/2009 | Fegelman et al. |
| 7,604,715 | B2 | 10/2009 | Liesen et al. |
| 7,622,517 | B2 | 11/2009 | Bauer et al. |
| 7,674,522 | B2 | 3/2010 | Pohlmann |
| 7,744,143 | B2 | 6/2010 | Gladfelter et al. |
| 2007/0202771 | A1 | 8/2007 | Douglass et al. |
| 2007/0209307 | A1 | 9/2007 | Andersen |
| 2008/0050565 | A1 | 2/2008 | Gross et al. |
| 2008/0121461 | A1 | 5/2008 | Gross et al. |
| 2008/0211253 | A1 | 9/2008 | Gladfelter et al. |
| 2009/0068430 | A1 | 3/2009 | Troger et al. |
| 2010/0066121 | A1 | 3/2010 | Gross |
| 2010/0168286 | A1 | 7/2010 | Gladfelter et al. |
| 2012/0255695 | A1 | 10/2012 | Sealey et al. |

FOREIGN PATENT DOCUMENTS

| | | |
|---|---|---|
| WO | 9632459 | 10/1996 |
| WO | 0236517 | 5/2002 |
| WO | 2005012638 | 2/2005 |
| WO | 2005042859 | 5/2005 |
| WO | 20050274472 | 12/2005 |
| WO | 2006107847 | 10/2006 |
| WO | 2008005936 | 1/2008 |

* cited by examiner

PARTIALLY FIRE RESISTANT INSULATION MATERIAL COMPRISING UNREFINED VIRGIN PULP FIBERS AND WOOD ASH FIRE RETARDANT COMPONENT

FIELD OF THE INVENTION

The present invention broadly relates to an at least partially fire resistant cellulosic fiber insulation material comprising unrefined virgin softwood and hardwood wood pulp fibers in a fibrous web, and a wood ash fire retardant component present in an amount of at least 1.5% by weight (based on the fibrous web) in and/or on the fibrous web and sufficient to impart at least partial fire resistance to the fibrous web. The present invention also broadly relates to a process for preparing this at least partially fire resistant insulation material.

BACKGROUND

Thermal insulation is used in many building structures including homes, offices, etc. Thermal insulation may provide energy efficiencies in the building, more uniform temperatures throughout the building space, minimal recurring expense, etc. In, for example, home insulation, the effectiveness of thermal insulation is commonly evaluated by its R-value which is a measure of thermal resistance of the insulation ("heat loss retardation") under specified test conditions. Generally, the higher the R-value is, the more effective is the material as a thermal insulator or barrier. In addition to its thermal barrier properties, thermal insulation may provide other benefits such as, for example, absorbing noise or vibrations (i.e., also provides acoustical insulation), fire resistance, etc.

Thermal insulation may be prepared from a variety materials which reduce the rate of heat transfer. These materials may include glass fibers (fiberglass), polystyrene, polyurethane foam, vermiculite, cellulosic fibers (e.g., wood fibers, cotton fibers, etc.), etc. For example, thermal insulation may be prepared from fiberglass in the form of pre-cut batts, blankets formed from continuous rolls, etc. Potential drawbacks of fiberglass insulation is that it may be challenging to install in certain building locations, may not be as easy to recycle, may eventually pose environmental issues due to the glass fibers it is formed from, may be more expensive than other insulation materials, etc.

Thermal insulation may also be prepared from polymer foams such as foamed polystyrene, polyurethane foam, etc. For example, in the case of polyurethane foam, a two component mixture may be combined at the tip of a spray gun, and thus form an expanding foam which is sprayed onto concrete slabs, into wall cavities (spaces) of an unfinished wall, against the interior side of wall sheathing, through holes drilled in such sheathing or drywall into the wall cavity (space) of a finished wall, etc. Potential drawbacks of such polymer foam insulation are relatively high cost, may release hazardous fumes when burned, may include environmentally hazardous monomers (e.g., isocyanates), may shrink during curing, may involve blowing agents that create environmental issues (e.g., "greenhouse gases"), etc.

Thermal insulation may also be prepared from cellulosic fibers in the form flexible batts, rigid panels, etc. Batts formed from such cellulosic fiber insulation may be more difficult to cut. Instead, the cellulosic fiber insulation may be in the form of a loose fill material. In the case of loose fill materials, this cellulosic fiber insulation often comprises wood fibers derived from recycled paper (e.g., newspaper).

This loose-fill cellulosic fiber insulation may be blown, pumped, etc., into spaces, cavities, etc., (e.g., in to attic areas, into cavities, spaces, etc., in walls, etc.) into the building structure during installation. Potential drawbacks of such loose-fill insulation materials include settling over time, thus decreasing its thermal insulation value, lack of fire resistance unless fire retardant materials are incorporated, etc. Also, such blown in loose-fill cellulosic fiber insulation primarily depends upon reliable sources of recycled paper to be cost effective. As more and more businesses and homes go "paperless," such sources of recycled paper for such blown in loose-fill cellulosic fiber insulation may eventually be on the decline.

SUMMARY

According to a first broad aspect of the present invention, there is provided an article comprising an at least partially fire resistant cellulosic fiber thermal insulation material comprising:

a fibrous web providing an R-value (as measured by the ASTM C518 test) of at least about 3 and comprising:
- from about 5 to about 85% unrefined virgin softwood pulp fibers by weight of the fibrous web; and
- from about 15 to about 95% unrefined virgin hardwood pulp fibers by weight of the fibrous web; and at least about 1.5% by weight of the fibrous web of a wood ash fire retardant component in and/or on the fibrous web and sufficient to impart at least partial fire resistance (as measured by the ASTM E970-08A test) to the fibrous web.

According to a second broad aspect of the present invention, there is provided a process comprising the following steps:

a. providing a fibrous web providing an R-value (as measured by the ASTM C518 test) of at least about 3 and comprising:
   - from about 5 to about 85% unrefined virgin softwood pulp fibers by weight of the fibrous web; and
   - from about 15 to about 95% unrefined virgin hardwood pulp fibers by weight of the fibrous web; and b. treating the fibrous web with a wood ash fire composition comprising a wood ash fire retardant component such that wood ash fire retardant component is present in and/or on the fibrous web in an amount of at least about 1.5%, by weight of the fibrous web and sufficient to provide a cellulosic fiber thermal insulation material which is at least partially fire resistant (as measured by the ASTM E970-08A test).

BRIEF DESCRIPTION OF THE DRAWINGS

The invention will be described in conjunction with the accompanying drawings, in which.

The FIG. 1 is a schematic diagram which shows an illustrative process for providing at least partially fire resistant thermal cellulosic fiber insulation material according to an embodiment of the present invention.

DETAILED DESCRIPTION

Figure 1:
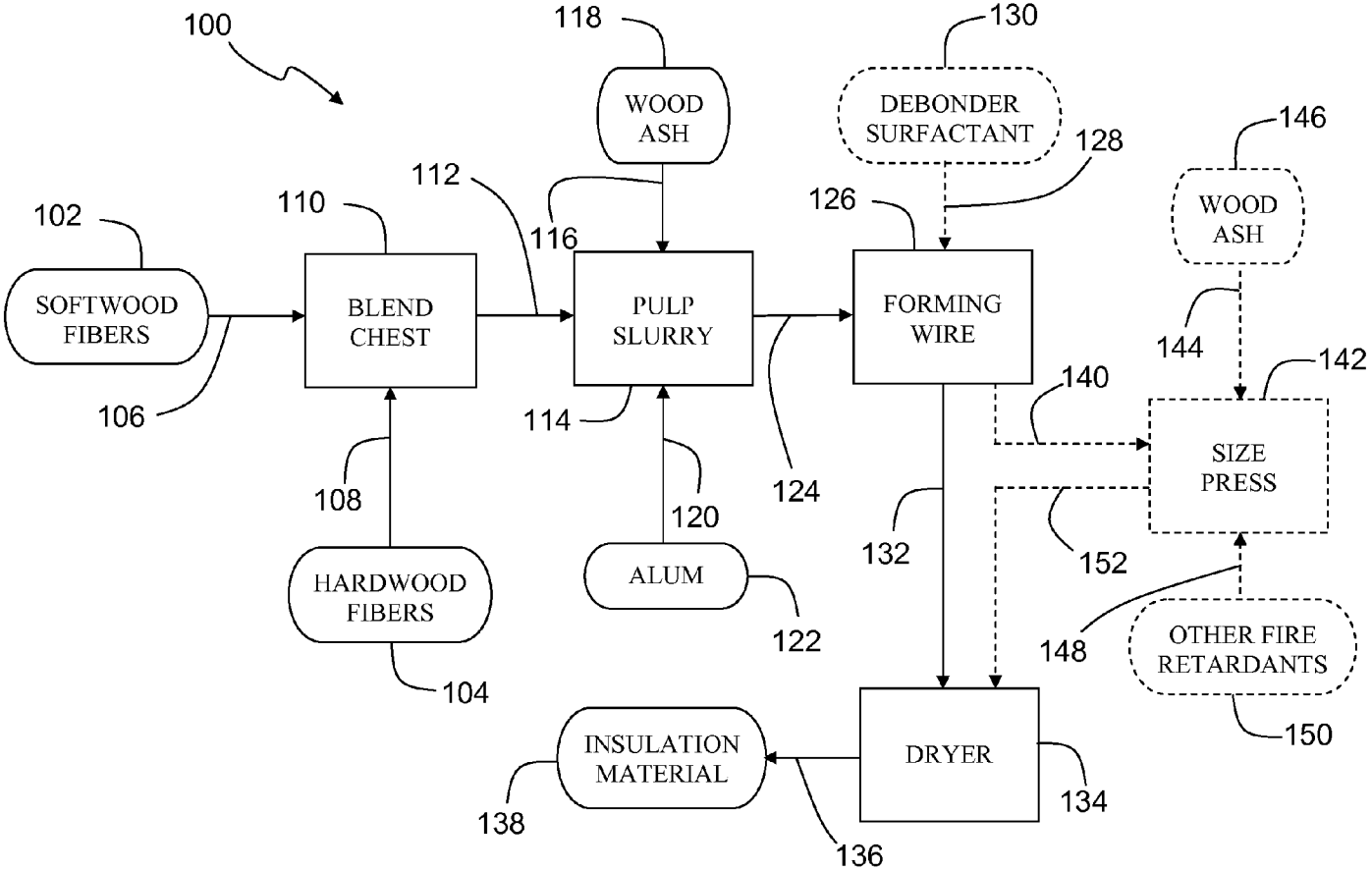

It is advantageous to define several terms before describing the invention. It should be appreciated that the following definitions are used throughout this application.

Definitions

Where the definition of terms departs from the commonly used meaning of the term, applicant intends to utilize the definitions provided below, unless specifically indicated.

For the purposes of the present invention, directional terms such as "top," "bottom," "side," "front," "frontal," "forward," "rear," "rearward," "back," "trailing," "above," "below," "left," "right," "horizontal," "vertical," "upward," "downward," etc., are merely used for convenience in describing the various embodiments of the present invention. The embodiments shown in FIGS. 1 through 4 may be flipped over, rotated by 90° in any direction, etc.

For the purposes of the present invention, the term "thermal insulation" refers to materials which reduce the rate of heat transfer.

For the purposes of the present invention, the term "R-value" refers to the conventional measure of thermal resistance (thermal insulation) used in the building and construction industry. Under uniform conditions, the R-value measures the ratio of the thermal temperature difference across an insulating material and the heat flux through it (i.e., is a measure of the insulating material's heat loss retardation). Generally, the higher the R-value of the material, the more effective the material functions as an insulator. R-values may be given in terms of $m^{2\circ}$ K/W, or the equivalent in terms of $m^{2\circ}$ C./W (International System of Units), or $ft^{2\circ}$ Fh/BTU (United States customary units). For purposes of the present invention, the R-value is measured according to test method ASTM C518 (Standard Test Method for Steady-State Thermal Transmission Properties by Means of a Heat Flow Meter Apparatus) which provides values in terms of United States customary units.

For the purposes of the present invention, the term "fibrous web" refers to a fibrous cellulosic matrix comprising at least unrefined virgin softwood fibers and unrefined virgin hardwood fibers. The fibrous web may be in the form of, for example, sheets, strips, pieces, batts/battings, blankets, etc., which may be in the form of a continuous roll, a discrete sheet, etc.

For the purposes of the present invention, the term "virgin pulp fibers" refers to wood pulp fibers which are derived from pulp obtained directly from wood sources (e.g., trees), and which are not derived from recycled sources, such as recycled paper.

For the purposes of the present invention, the terms "batt," "batting," and "blanket" refer interchangeably herein to a piece, sheet, strip, etc., of thermal insulation material.

For the purposes of the present invention, the term "softwood pulp fibers" refers to fibrous pulps (pulp fibers) derived from the woody substance of coniferous trees (gymnosperms) such as varieties of fir, spruce, pine, etc., for example, loblolly pine, slash pine, Colorado spruce, balsam fir, Douglas fir, jack pine, radiata pine, white spruce, lodgepole pine, redwood, etc. North American southern softwoods and northern softwoods may be used to provide softwood pulp-fibers, as well as softwoods from other regions of the world.

For the purposes of the present invention, the term "hardwood pulp fibers" refers to fibrous pulps (pulp fibers) derived from the woody substance of deciduous trees (angiosperms) such as birch, oak, beech, maple, eucalyptus, poplars, etc.

For the purposes of the present invention, the term "unrefined pulp fibers" refers to wood pulp fibers which have not been refined, i.e., have not be subjected to a process of mechanical treatment, such as beating, to develop or modify the pulp fibers, often to increase fiber bonding strength and/or improve surface properties. See G. A. Smook, Handbook for Pulp and Paper Technologists ($2^{nd}$ Edition, 1992), page 191-202, the entire contents and disclosure of which is herein incorporated by reference, for a general description of the refining of pulp fibers.

For the purposes of the present invention, the term "basis weight," refers to the grammage of the wood pulp fibers, fibrous web, etc., as determined by TAPPI test T410. See G. A. Smook, Handbook for Pulp and Paper Technologists ($2^{nd}$ Edition, 1992), page 342, Table 22-11, the entire contents and disclosure of which is herein incorporated by reference, which describes the physical test for measuring basis weight.

For the purposes of the present invention, the term "moisture content," refers to the amount of water present in the fibrous web as measured by TAPPI test T210 cm-03.

For the purposes of the present invention, the term "pulp filler" refers commonly to mineral products (e.g., calcium carbonate, kaolin clay, calcium sulfate hemihydrate, calcium sulfate dehydrate, chalk, etc.) which may be used in fibrous pulp making to reduce materials cost per unit mass of the fibrous web, increase opacity, etc. These mineral products may be finely divided, for example, in the size range of from about 0.5 to about 5 microns.

For the purposes of the present invention, the term "pulp pigment" refers to a material (e.g., a finely divided particulate matter) which may be used or may be intended to be used to affect optical properties of fibrous web, etc. Pulp pigments may include one or more of: calcium carbonate, kaolin clay, calcined clay, modified calcined clay, aluminum trihydrate, titanium dioxide, talc, plastic pigment, amorphous silica, aluminum silicate, zeolite, aluminum oxide, colloidal silica, colloidal alumina slurry, etc.

For the purposes of the present invention, the term "calcium carbonate" refers various calcium carbonates which may be used as pulp pigments, such as precipitated calcium carbonate (PCC), ground calcium carbonate (GCC), modified PCC and/or GCC, etc.

For the purposes of the present invention, the term "precipitated calcium carbonate (PCC)" refers to a calcium carbonate which may be manufactured by a precipitation reaction and which may used as a pulp pigment. PCC may comprise almost entirely of the calcite crystal form of $CaCO_3$. The calcite crystal may have several different macroscopic shapes depending on the conditions of production. Precipitated calcium carbonates may be prepared by the carbonation, with carbon dioxide ($CO_2$) gas, of an aqueous slurry of calcium hydroxide ("milk of lime"). The starting material for obtaining PCC may comprise limestone, but may also be calcined (i.e., heated to drive off $CO_2$), thus producing burnt lime, CaO. Water may added to "slake" the lime, with the resulting "milk of lime," a suspension of $Ca(OH)_2$, being then exposed to bubbles of $CO_2$ gas. Cool temperatures during addition of the $CO_2$ tend to produce rhombohedral (blocky) PCC particles. Warmer temperatures during addition of the $CO_2$ tend to produce scalenohedral (rosette-shaped) PCC particles. In either case, the end the reaction occurs at an optimum pH where the milk of lime has been effectively converted to $CaCO_3$, and before the concentration of $CO_2$ becomes high enough to acidify the suspension and cause some of it to redissolve. In cases where the PCC is not continuously agitated or stored for many days, it may be necessary to add more than a trace of such anionic dispersants as polyphosphates. Wet PCC may have a weak cationic colloidal charge. By contrast, dried PCC may be similar to most ground $CaCO_3$ products in having a negative charge, depending on whether dispersants have been used. The calcium carbonate may be precipitated from an aqueous solution in three different crystal forms: the vaterite form which is thermodynamically unstable, the calcite form which is the most stable and the most abundant in nature, and the aragonite form which is metastable under normal ambient conditions of temperature and pressure, but which may convert to calcite at elevated temperatures. The aragonite form has an orthorhombic shape that crystallizes as long, thin needles that may be either aggregated or unaggregated. The calcite form may exist in several different shapes of which the most commonly found are the rhombohedral shape having crystals that may be either aggregated or unaggregated and the scalenohedral shape having crystals that are generally unaggregated.

For the purposes of the present invention, the term "comminuting" refers to defibrizing, disintegrating, shredding, fragmenting, etc., the fibrous web to provide a loose fiber mixture (e.g., for loose-fill cellulose insulation).

For the purposes of the present invention, the term "loose-fill cellulose insulation" refers to a loose, generally free-flowing, fiber mixture formed by comminuting a fibrous mixture which may be used in providing, for example, blown-in cellulose insulation.

For the purposes of the present invention, the term "trivalent metal" refers to a metal which may have a positive charge of three (e.g., boron, zinc, an iron (ferric), cobalt, nickel, aluminum, manganese, chromium, etc.), and may include combinations of one or more of these trivalent metals. Sources of trivalent metals may include one or more of organic or inorganic salts, for example, from one or more of the following anions: acetate, lactate, EDTA, halide, chloride, bromide, nitrate, chlorate, perchlorate, sulfate, acetate, carboxylate, hydroxide, nitrite, etc. The salt may be a simple salt, wherein the trivalent metal forms a salt with one or more of the same anion, or a complex salt, wherein the trivalent metal forms a salt with two or more different anions. In some embodiments, the salt may be aluminum chloride, aluminum carbonate, aluminum sulfate, alum (e.g., aluminum ammonium sulfate, aluminum potassium sulfate, aluminum sulfate, etc.), etc.

For the purposes of the present invention, the term "debonder surfactant" refers to surfactants which are useful in the treatment of wood pulp fibers to reduce inter-fiber bonding. Suitable debonder surfactants may include one or more of: cationic surfactants or nonionic surfactants, such as linear or branched monoalkyl amines, linear or branched dialkyl amines, linear or branched tertiary alkyl amines, linear or branched quaternary alkyl amines, linear or branched, saturated or unsaturated hydrocarbon surfactants, fatty acid amides, fatty acid amide quaternary ammonium salts, dialkyl dimethyl quaternary ammonium salts, dialkylimidazolinium quaternary ammonium salts, dialkyl ester quaternary ammonium salts, triethanolamine-ditallow fatty acids, fatty acid ester of ethoxylated primary amines, ethoxylated quaternary ammonium salts, dialkyl amide of fatty acids, dialkyl amide of fatty acids, ethoxylated alcohols, such as $C_{16}$-$C_{18}$ unsaturated alkyl alcohol ethoxylates, commercially available compound having CAS Registry No. 68155-01-1, commercially available compound having CAS Registry No. 26316-40-5, commercially available Eka Chemical F60™ (an ethoxylated alcohol surfactant), commercially available Cartaflex TS LIQ™, commercially available F639™, commercially available Hercules PS9456™, commercially available Cellulose Solutions 840™, commercially available Cellulose Solutions 1009™, commercially available EKA 509H™, commercially available EKA 639™, etc. See also U.S. Pat. No. 4,425,186 (May et al.), issued Jan. 10, 1984, the entire contents and disclosure of which is hereby incorporated by reference, which discloses a combination of a cationic surfactant and a dimethylamide of a straight chain carbon carboxylic acid containing 12 to 18 carbon atoms which may be useful as a debonder surfactant.

For the purposes of the present invention, the term "fire resistance" refers to the ability of a material (e.g., a fibrous web, etc.) to be resistant to fire, flame, burning, etc., as determined by certain fire resistance test(s), such as the ASTM E970-08A test, etc.

For the purposes of the present invention, the term "fire resistance test" refers to a test which measures the fire resistant characteristics, properties, etc., of an article, a material, etc. For the purposes of the present invention, fire resistance is measured in terms of test method ASTM E970-08A (Standard Test Method for Critical Radiant Flux of Exposed Attic Floor Insulation Using a Radiant Heat Energy Source).

For the purposes of the present invention, the term "partially fire resistant" refers to a material (e.g., a fibrous web, etc.) which has been treated with sufficient fire retardant such that the treated material has at least some measurable increase in fire resistance, as determined by the ASTM E970-08A test, relative to the untreated material. A treated material which passes the ASTM E970-08A test is referred to herein as being "significantly fire resistant."

For the purposes of the present invention, the term "fire retardant" refers to one or more substances (e.g., composition, compound, etc.) which are able to reduce, impart resistance to, etc., the flammability, the ability to burn, etc., of a material, article, etc. Fire retardants may include one or more of: wood ash fire retardants, fire retardants other than wood ash fire retardants, such as borate fire retardants, phosphorous fire retardants, halogenated hydrocarbon fire retardants, metal oxide fire retardants, etc. For example, the fire retardant may comprise a mixture, blend, etc., of one or more wood ash fire retardants, one or more borate fire retardants, one or more phosphorous fire retardants, one or more halogenated hydrocarbon fire retardants, and one or more metal oxide fire retardants.

For the purposes of the present invention, the "wood ash fire retardant" refers to a fire retardant composition comprising the components of wood ash. Wood ash is the residue remaining after the combustion (burning) of wood. Wood ash may comprise, for example, between about 0.43% and about 1.82% of the mass (solids basis) of burned wood. A major component of wood ash obtained from burned wood is calcium carbonate. Wood ash may also comprise other components such as potash (potassium salts), such as potash alum (potassium aluminum sulfate), phosphates, sodium carbonate, clays, talc, etc., as well as trace quantities of iron, manganese, zinc, copper, heavy metals, etc. The wood ash fire retardant used in embodiments of the present invention may be derived directly from wood ash or may be formed from the components present in wood ash. Some illustrative embodiments of wood ash fire retardant components herein may comprise, for example, one or more of: calcium carbonate; potash alum (potassium aluminum sulfate); sodium carbonate; clay; talc; etc.

For the purposes of the present invention, the term "borate fire retardant" refers to a fire retardant substance, compound, molecule, etc., which comprises one or more boron atoms. Borate fire retardants may include one or more of: boric acid, borax, sodium tetraborate decahydrate, borosilicates (e.g., sodium borosilicates, potassium borosilicates, etc.), etc.)

For the purposes of the present invention, the term "phosphorous fire retardant" refers to a fire retardant substance, compound, molecule, etc., which comprises one or more phosphorous atoms. Phosphorous fire retardants may include one or more of: phosphates, such as sodium phosphates, ammonium phosphates, sodium polyphosphates, ammonium polyphosphates, melamine phosphates, ethylenediamine phosphates etc.; red phosphorus; metal hypophosphites, such as aluminum hypophosphite and calcium hypophosphite; phosphate esters; etc. Some proprietary phosphorous fire retardants may include, for example: Spartan™ AR 295 Flame Retardant from Spartan Flame Retardants Inc. of Crystal Lake, Ill., include both organic and inorganic constituents, GLO-TARD FFR2, which is an ammonium polyphosphate fire retardant from GLO-TEX International, Inc. of Spartanburg, S.C.; Fire Retard 3496, which is a phosphate ester supplied by Manufacturers Chemicals, L.P. of Cleveland, Term, Flovan CGN, a multi-purpose phosphate-based flame retardant supplied by Huntsman (Salt Lake City, Utah); SPARTAN™ AR 295, a diammonium phosphate based flame retardant from Spartan Flame Retardants, Inc. (Crystal Lake, Ill.), FRP 12™, FR 165™, and FR8500™ supplied by Cellulose Solutions, LLC (Daphne, Ala.), etc.

For the purposes of the present invention, the term "halogenated organic fire retardant" refers to a halogenated organic compound which alone, or in combination with other substances, compounds, molecules, etc., are capable of functioning as a fire retardant. Halogenated organic fire retardants may include one or more of: halogenated (e.g., chlorinated, brominated, etc.) hydrocarbons, such as halogenated aliphatics (e.g., haloalkanes), halogenated aromatics, etc. Halogenated organic fire retardants may include chloroparaffins, Dechorane Plus (a chlorine-containing halogenated fire retardant), decabromodiphenyl oxide, tetradecabromodiphenoxybenzene, ethylenebispentabromobenzene (EBPB); tetrabromobisphenol A (TBBA), tetrabromobisphenol A bis-hexabromocyclododecane, ethylenebis-(tetrabromophthalimide). These halogenated organic fire retardants may work by eliminating oxygen from the burn zone which quenches, extinguishes, smothers, puts out, etc., the flame.

For the purposes of the present invention, the term "metal oxide fire retardant" refers to metal oxides which alone, or in combination with other substances, are capable of functioning as a fire retardant. Metal oxide fire retardants may include one or more of: aluminum oxide (alumina), antimony trioxide, ferric oxide, titanium dioxide, stannic oxide, etc.

For the purposes of the present invention, the term "solids basis" refers to the weight percentage of each of the respective solid materials, compounds, substances, etc., (e.g., pulp fibers, fire retardants, surfactants, etc.) present in the pulp slurry, furnish, fibrous web, composition, etc., in the absence of any liquids (e.g., water). Unless otherwise specified, all percentages given herein for the solid materials, compounds, substances, etc., are on a solids basis.

For the purposes of the present invention, the term "solids content" refers to the percentage of non-volatile, non-liquid components (by weight) that are present in the composition, etc.

For the purposes of the present invention, the term "gsm" is used in the conventional sense of referring to grams per square meter.

For the purposes of the present invention, the term "liquid" refers to a non-gaseous fluid composition, compound, material, etc., which may be readily flowable at the temperature of use (e.g., room temperature) with little or no tendency to disperse and with a relatively high compressibility.

For the purposes of the present invention, the term "room temperature" refers to the commonly accepted meaning of room temperature, i.e., an ambient temperature of 20° to 25° C.

For the purposes of the present invention, the term "optical brightness" refers to the diffuse reflectivity of the pulp web/fibers, for example, at a mean wavelength of light of 457 nm. As used herein, optical brightness of pulp webs may be measured in terms of ISO Brightness which measures brightness using, for example, an ELREPHO Datacolor 450 spectrophotometer, according to test method ISO 2470-1, using a C illuminant with UV included.

For the purposes of the present invention, the term "optical brightener agent (OBA)" refers to certain fluorescent materials which may increase the brightness (e.g., white appearance) of pulp web surfaces by absorbing the invisible portion of the light spectrum (e.g., from about 340 to about 370 nm) and converting this energy into the longer-wavelength visible portion of the light spectrum (e.g., from about 420 to about 470 nm). In other words, the OBA converts invisible ultraviolet light and re-emits that converted light into blue to blue-violet light region through fluorescence. OBAs may also be referred to interchangeably as fluorescent whitening agents (FWAs) or fluorescent brightening agents (FBAs). The use of OBAs is often for the purpose of compensating for a yellow tint or cast of paper pulps which have, for example, been bleached to moderate levels. This yellow tint or cast is produced by the absorption of short-wavelength light (violet-to-blue) by the pulp webs. With the use of OBAs, this short-wavelength light that causes the yellow tint or cast is partially replaced, thus improving the brightness and whiteness of the pulp web. OBAs are desirably optically colorless when present on the pulp web surface, and do not absorb light in the visible part of the spectrum. These OBAs may be anionic, cationic, anionic (neutral), etc., and may include one or more of: stilbenes, such as 4,4'-bis-(triazinylamino)-stilbene-2,2'-disulfonic acids, 4,4'-bis-(triazol-2-yl)stilbene-2,2'-disulfonic acids, 4,4'-dibenzofuranyl-biphenyls, 4,4'-(diphenyl)-stilbenes, 4,4'-distyryl-biphenyls, 4-phenyl-4'-benzoxazolyl-stilbenes, stilbenzyl-naphthotriazoles, 4-styryl-stilbenes, bis-(benzoxazol-2-yl) derivatives, bis-(benzimidazol-2-yl) derivatives, coumarins, pyrazolines, naphthalimides, triazinyl-pyrenes, 2-styryl-benzoxazole or -naphthoxazoles, benzimidazole-benzofurans or oxanilides, etc, See commonly assigned U.S. Pat. No. 7,381,300 (Skaggs et al.), issued Jun. 3, 2008, the entire contents and disclosure of which is herein incorporated by reference. In particular, these OBAs may comprise, for example, one or more stilbene-based sulfonates (e.g., disulfonates, tetrasulfonates, or hexasulfonates) which may comprise one or two stilbene residues. Illustrative examples of such anionic stilbene-based sulfonates may include 1,3,5-triazinyl derivatives of 4,4'-diaminostilbene-2,2'-disulphonic acid (including salts thereof), and in particular the bistriazinyl derivatives (e.g., 4,4-bis(triazine-2-ylamino) stilbene-2,2'-disulphonic acid), the disodium salt of distyrylbiphenyl disulfonic acid, the disodium salt of 4,4'-di-triazinylamino-2,2'-di-sulfostilbene, etc. Commercially available disulfonate, tetrasulfonate and hexasulfonate stilbene-based OBAs may also be obtained, for example, from Ciba Geigy under the trademark TINOPAL®, from Clariant under the trademark LEUCOPHOR®, from Lanxess under the trademark BLANKOPHOR®, and from 3V under the trademark OPTIBLANC®.

For the purpose of the present invention, the term "treating" with reference to the fire retardant compositions may include adding, depositing, applying, spraying, coating, daubing, spreading, wiping, dabbing, dipping, etc.

For the purposes of the present invention, the term "applicator" refers to a device, equipment, machine, etc., which may be used to treat, apply, coat, etc., one or more sides or surfaces of a fibrous web with the fire retardant composition. Applicators may include air-knife coaters, rod coaters, blade coaters, size presses, etc. See G. A. Smook, Handbook for Pulp and Paper Technologists ($2^{nd}$ Edition, 1992), pages 289-92, the entire contents and disclosure of which is herein incorporated by reference, for a general description of coaters that may be useful herein. Size presses may include a puddle size press, a metering size press, etc. See G. A. Smook, Handbook for Pulp and Paper Technologists ($2^{nd}$ Edition, 1992), pages 283-85, the entire contents and disclosure of which is herein incorporated by reference, for a general description of size presses that may be useful herein.

For the purposes of the present invention, the term "flooded nip size press" refers to a size press having a flooded nip (pond), also referred to as a "puddle size press." Flooded nip size presses may include vertical size presses, horizontal size presses, etc.

For the purposes of the present invention, the term "metering size press" refers to a size press that includes a component for spreading, metering, etc., deposited, applied, etc., the fire retardant composition on a fibrous web. Metering size presses may include a rod metering size press, a gated roll metering size press, a doctor blade metering size press, etc.

For the purposes of the present invention, the term "rod metering size press" refers to metering size press that uses a rod to spread, meter, etc., the fire retardant composition on a pulp web, air-laid fibrous structure, etc. The rod may be stationary or movable relative to the web.

For the purposes of the present invention, the term "gated roll metering size press" refers to a metering size press that may use a gated roll, transfer roll, soft applicator roll, etc. The gated roll, transfer roll, soft applicator roll, etc., may be stationery relative to the web, may rotate relative to the web, etc.

For the purposes of the present invention, the term "doctor blade metering size press" refers to a metering press which may use a doctor blade to spread, meter, etc., the fire retardant composition on a fibrous web.

For the purposes of the present invention, the term "disc refiner" refers to a device comprising a rotating disc-stator assembly which may be used for comminuting (e.g., defibrizing, disintegrating, shredding, fragmenting, etc.) fibrous materials into a loose-fill material for use in, for example, blown-in insulation. See G. A. Smook, Handbook for Pulp and Paper Technologists ($2^{nd}$ Edition, 1992), page 196-201, the entire contents and disclosure of which is herein incorporated by reference, for a general description of disc refiners. Illustrative disc refiners suitable for use in comminuting (e.g., defibrizing, disintegrating, shredding, fragmenting, etc.) fibrous materials into a loose-fill material for suitable use in blown-in insulation include those disclosed in, for example, U.S. Pat. No. 5,011,091 (Kopecky), issued Apr. 30, 1991; U.S. Pat. No. 2,982,482 (Curtis), issued; U.S. Pat. No. 3,049,307 (Dalzell), issued Aug. 14, 1962; U.S. Pat. No. 2,654,295 (Sutherland), issued Oct. 6, 1953; U.S. Pat. No. 3,815,834 (Gilbert), issued Jun. 11, 1974, the entire contents and disclosures of which are herein incorporated by reference.

Description

Embodiments of the at least partially fire resistant cellulosic fiber thermal insulation material of the present invention may comprise a fibrous web comprising from about 5 to about 85% (for example, from about 10 to about 60%, such as from about 15 to about 30%) unrefined virgin softwood pulp fibers (by weight of the fibrous web); and from about 15 to about 95% (for example, from about 40 to about 90%, such as from about 70 to about 85%) unrefined virgin hardwood fibers (by weight of the fibrous web); and at least about 1.5% by weight of the fibrous web of a wood ash fire retardant component in and/or on the fibrous web, for example, from about 1.5 to about 20% by weight (based on the fibrous web), such as from about 1.5 to about 5% weight (based on the fibrous web), and sufficient to impart at least partial fire resistance (as measured by the ASTM E970-08A test) to the fibrous web. Amounts of the wood ash fire retardant component above about 20% by weight (based on the fibrous web) are usable in embodiments of the present invention, but may also provide a sufficient amount of fine particles to cause excessive dustiness in the at least partially fire resistant cellulosic fiber thermal insulation material.

The fibrous web provides an R-value of at least about 3 (as measured by the ASTM C518 test), for example, R-values in the range of from about 3 to about 4.5, such as from about 3.4 to about 4.2. The fibrous web may have a basis weight about 850 gsm or less (for example, about 500 gsm or less). The fibrous web may also have a moisture content of less than about 20% (for example, about 12% or less). The fibrous web may further include one or more debonder surfactants in an amount (based on the fibrous web) of, for example, from about 0.05 to about 0.35% by weight, such as from about 0.075 to about 0.15% by weight. Including one or more debonder surfactants may lower the amount of energy which may be required to in comminuting (e.g., defibrizing, disintegrating, shredding, fragmenting, etc.) the fire resistant cellulosic fiber thermal insulation material with, for example, a disc refiner to provide a loose-fill blown-in insulation material. Lower the energy required in comminuting (e.g., defibrizing, disintegrating, shredding, fragmenting, etc.) the fire resistant cellulosic fiber thermal insulation material may provide a beneficial decrease in the amount of dust generated. Inclusion of one or more debonder surfactants may also enhance the anti-mold properties of embodiments of the fire resistant cellulosic fiber thermal insulation material, as well as increase the bulk of the material (e.g., meaning less material may be required per bag, package, etc., that the material is distributed in).

Embodiments of the process of the present invention for providing fire resistant fibrous webs may comprise the following steps: (1) providing a fibrous web providing an R-value (as described above) comprising unrefined virgin softwood and hardwood pulp fibers (in amounts as described above); and (2) treating the fibrous web with wood ash fire retardant composition comprising wood ash fire retardant component such that the wood ash fire retardant component is present in and/or on the fibrous web in an amount of at least about 1.5%, by weight of the fibrous web and sufficient to provide a cellulosic fiber thermal insulation material which is at least partially fire resistant (as measured by the ASTM E970-08A test).

In treating the fibrous web with the wood ash fire retardant composition, the wood ash fire retardant composition may be provide as a solid granular or powered mixture, as a slurry have, for example, a paste-like consistency, as a liquid dispersion, as a liquid solution, etc. The fibrous web may be treated with the wood ash fire retardant composition in a variety places during the making of the fire resistant thermal insulation material. For example, the wood retardant fire retardant composition may be applied by a papermaking size press, a paper coater, a sprayer, a dispenser, a douser, etc. The incorporation, addition, etc., of one or more trivalent metal cations (e.g., aluminum such as in the form of, for example, alum as the source) in and/or on the fibrous web (e.g., in the blend chest or in the pulp slurry at least prior to the headbox which deposits the fibrous furnish on the forming wire) prior to treatment with the wood ash fire retardant composition, with or without debonder surfactant, may also enable the fire retardant composition to be distributed and dispersed more thoroughly, homogeneously, etc., and may also aid, assist, etc., in having the fire retardants crosslink, bond, cure, etc., more effectively to the cellulosic fibers in the fibrous web.

In some embodiments of the at least partially fire resistant cellulosic fiber insulation material, the fibrous web may be treated with a fire retardant component which comprises a mixture, blend, etc., of one or more wood ash fire retardants, along with one or more of these other fire retardants, for example, to provide a significantly fire resistant cellulosic fiber insulation material, i.e., passes the ASTM E970-08A test. For example, the fibrous web may also be treated with one or more borate fire retardants, phosphorous fire retardants, halogenated hydrocarbon fire retardants, metal oxide fire retardants, etc. The fibrous web may be treated with these one or more other fire retardants in amounts sufficient to render the cellulosic fiber insulation material significantly fire resistant, i.e., sufficient to pass the ASTM E970-08A test. For example, these other fire retardants may be added in amounts of from about 15 to about 25% by weight (based on the fibrous web), such as from about 15 to about 18% by weight.

Embodiments of the at least partially fire resistant cellulosic fiber thermal insulation material of the present invention may be provided in the form of sheets, pieces, rolls, etc. The fire resistant cellulosic fiber thermal insulation material may be comminuted (e.g., defiberized, disintegrated, shredded, fragmented, etc.) to provide loose-fill cellulose insulation using known methods. For example, the at least partially fire resistant cellulosic fiber thermal insulation material may be defiberized, disintegrated, shredded, fragmented, etc., by using a disc refiner. The resultant at least partially fire resistant loose-fill cellulose insulation may then be used to provide blown-in cellulose insulation in various building structures including homes, offices, etc.

Embodiments the process of the present invention for providing at least partially fire resistant cellulosic fiber thermal insulation material are further illustrated in FIG. 1. FIG. 1 is a schematic diagram which shows an illustrative process for providing an at least partially fire resistant thermal cellulosic fiber insulation material according to an embodiment of the present invention, which is indicated generally as 100. In process 100, unrefined virgin softwood pulp fibers (indicated as Softwood Fibers 102) and unrefined virgin hardwood pulp fibers (indicated as Hardwood Fibers 104) may be combined, blended together, etc., as indicated by respective arrows 106 and 108 in a Blend Chest, indicated generally as 110. For example, in one embodiment, Softwood Fibers 102 and Hardwood Fibers 104 may be mixed in Blend Chest 110 (together with any other optional additives such as pulp pigments, mixing/web penetration aids, debonder surfactants, etc.). As indicated by arrow 112, Blend Chest 110 provides a pulp mixture in the form of Pulp Slurry 114. As indicated by arrow 116, the wood ash fire retardant component (see Wood Ash 118) may be added to Pulp Slurry 114. As indicated by arrow 120, a source of trivalent metal ions, such as Alum 122, may also be added to Pulp Slurry 114. (Added Alum 122 may also provide some additional benefit as a fire retardant.)

As further shown in FIG. 1, after adding Wood Ash 116 and Alum 122 and as indicated by arrow 1124, Pulp Slurry 114 by may then be deposited (e.g., by using a headbox) as a furnish of wood pulp fibers, onto a forming wire, forming table, forming screen, forming fabric, etc., such as a Fourdrinier forming wire (see Forming Wire 126) to provide a fibrous web. As indicated by arrow 128, the fibrous web on Forming Wire 126 may also be optionally treated with Debonder Surfactant 130 by using, for example, a spray boom, to apply (spray) on Debonder Surfactant 130 on the fibrous web. The fibrous web on Forming Wire 126 (with or without Debonder Surfactant 130) may then be transferred, as indicated by arrow 132, to a Dryer 134, to provide a dried fibrous web. As indicated by arrow 136, the dried web from Dryer 134 provides a fire resistant cellulosic fiber thermal insulation material (see Insulation Material 138) which may be in the form of, for example, sheets, rolls, etc.

An alternative embodiment of process 100 is also shown in FIG. 1. In this alternative embodiment of process 100, Wood Ash 118 added to Pulp Slurry 114 provides only a portion of the total wood ash fire retardant component (e.g., from about 5 to 100%, such as from about 10 to about 90%, of the total wood ash fire retardant component) present in and/or through the fibrous web. Instead, the fibrous web from Forming Wire 126 passes through, as indicated by arrow 140, a Size Press, indicated generally as 142. At Size Press 142, the fibrous web may be treated, as indicated by arrow 144, with the remaining wood ash fire retardant component (e.g., from 0 to about 95%, such as from about 10 to about 90%, of the total wood ash fire retardant component), indicated as Wood Ash 146. (See, for example, FIGS. 2-4 and corresponding description below, for treating the fibrous web with the remaining portion of Wood Ash 146 using a Size Press 142.) As also shown in FIG. 1, the fibrous web may optionally be treated at Size Press 142, as indicated by arrow 148, with Other Fire Retardants 150, such as borate fire retardants, phosphorous fire retardants, halogenated hydrocarbon fire retardants, metal oxide fire retardants, etc. (In an alternative embodiment, instead of using Size Press 142, the fibrous web may be treated with the remaining Wood Ash 146 and/or Other Fire Retardants 150 by using, for example, a spray boom, to apply (spray) Wood Ash 146 and/or Other Fire Retardants 150 on the fibrous web.) After being treated with remaining Wood Ash 146 and/or Other Fire Retardants 150, the additionally treated fibrous web leaves Size Press 142, as indicated by arrow 152, and is then dried by Dryer 134.

Figure 2:
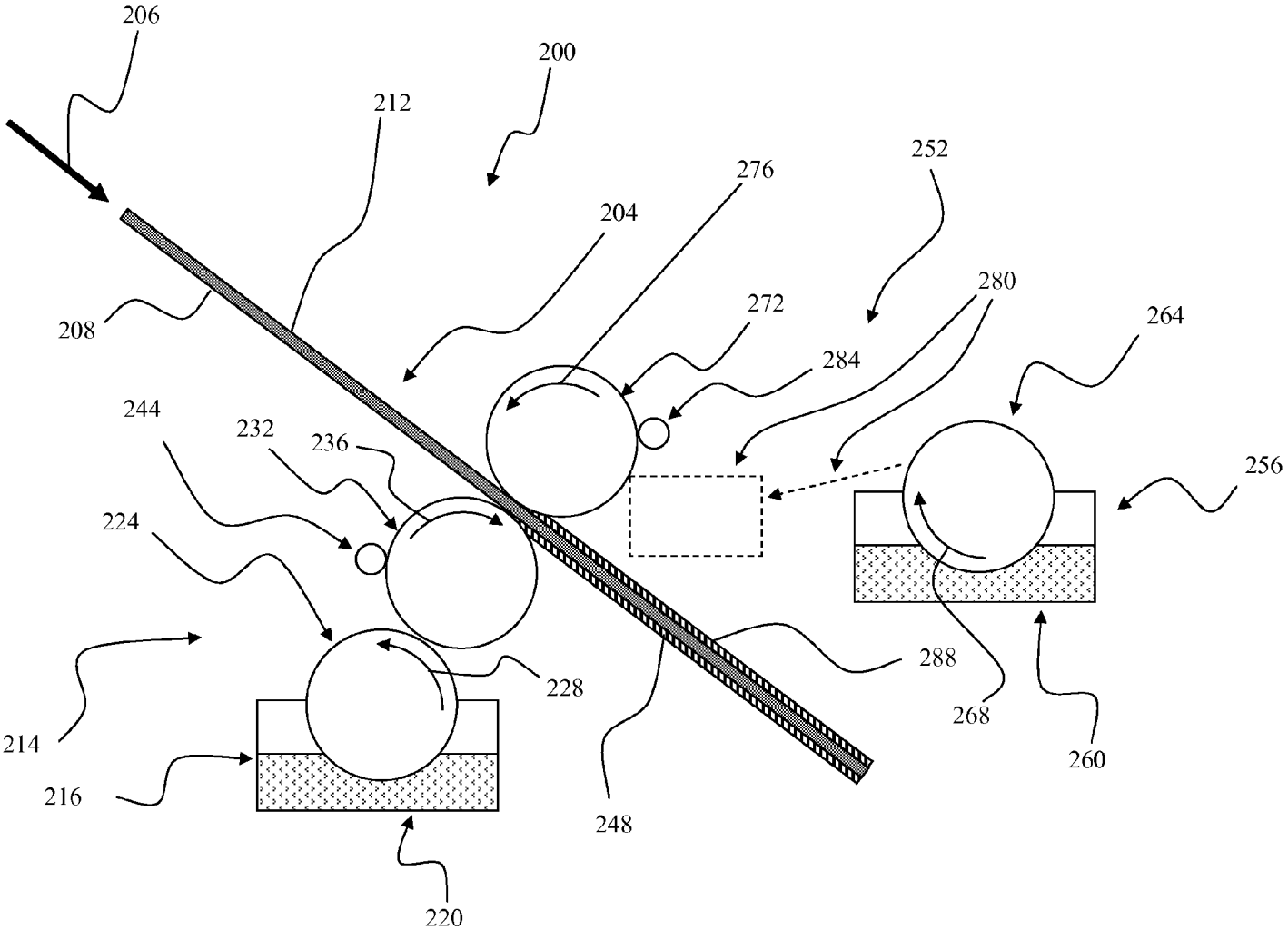
FIG. 2 a schematic diagram illustrating an embodiment of a process for treating one or both surfaces of a fibrous web with a wood ash fire retardant composition using a metering rod size press.

An embodiment of a process of the present invention for treating one or both surfaces of fibrous web with a fire retardant wood ash composition (e.g., such as the remaining portion of Wood Ash 146, as well as optional Other Fire Retardants 150) is further illustrated in FIG. 2. Referring to FIG. 2, an embodiment of a system for carrying out an embodiment of the process of the present invention is illustrated which may be in the form of, for example a rod metering size press indicated generally as 200. Size press 200 may be used to coat a fibrous web, indicated generally as 204. Web 204 moves in the direction indicated by arrow 206, and which has a pair of opposed sides or surfaces, indicated, respectively, as 208 and 212.

Size press 200 includes a first assembly, indicated generally as 214, for applying the wood ash fire retardant composition to surface 208. Assembly 214 includes a first reservoir, indicated generally as 216, provided with a supply of a fire retardant composition, indicated generally as 220. A first take up roll, indicated generally as 224 which may rotate in a counterclockwise direction, as indicated by curved arrow 228, picks up an amount of the fire retardant composition from supply 220. This amount of the wood ash fire retardant composition that is picked up by rotating roll 224 may then be transferred to a first applicator roll, indicated generally as 232, which rotates in the opposite and clockwise direction, as indicated by curved arrow 236. (The positioning of first take up roll 224 shown in FIG. 2 is simply illustrative and roll 224 may be positioned in various ways relative to first applicator roll 232 such that the wood ash fire retardant composition is transferred to the surface of applicator roll 232.) The amount of the wood ash fire retardant composition that is transferred to first applicator roll 232 may be controlled by metering rod 244 which spreads the transferred composition on the surface of applicator roll 232, thus providing relatively uniform and consistent thickness of a first coating, indicated as 248, when applied onto the first surface 208 of web 204 by applicator roll 232.

As shown in FIG. 2, size press 200 may also be provided with a second assembly indicated generally as 252, for applying the wood ash fire retardant composition to surface 212. Assembly 252 includes a second reservoir indicated generally as 256, provided with a second supply of a wood ash fire retardant composition, indicated generally as 260. A second take up roll, indicated generally as 264 which may rotate in a clockwise direction, as indicated by curved arrow 268, picks up an amount of the wood ash fire retardant composition from supply 260. This amount of wood ash fire retardant composition that is picked up by rotating roll 264 may then be transferred to second take up roll, indicated generally as 272, which rotates in the opposite and counterclockwise direction, as indicated by curved arrow 276. As indicated in FIG. 2 by the dashed-line box and arrow 276, second take up roll 264 may be positioned in various ways relative to second applicator roll 272 such that the wood ash fire retardant composition is transferred to the surface of applicator roll 272. The amount of wood ash fire retardant composition that is transferred to second applicator roll 272 may be controlled by a second metering rod 284 which spreads the transferred composition on the surface of applicator roll 272, thus providing relatively uniform and consistent thickness of the second coating, indicated as 288, when applied onto the second surface 212 of web 204 by applicator roll 272.

Figure 3:
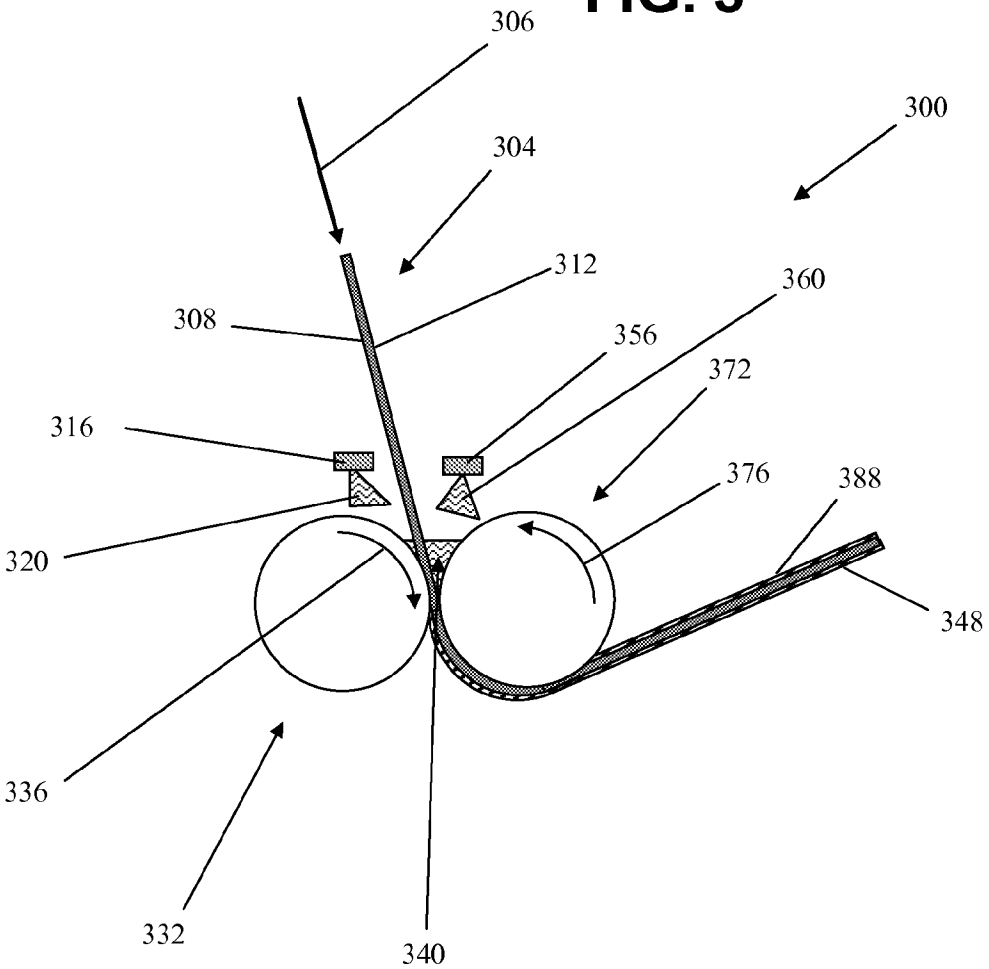
FIG. 3 a schematic diagram illustrating an embodiment of a process for treating one or both surfaces of a fibrous web with a wood ash fire retardant using a horizontal flooded nip size press.

Referring to FIG. 3, another embodiment of a system for carrying out an embodiment of the process of the present invention is illustrated which may be in the form of, for example, a horizontal flooded nip size press indicated generally as 300. Horizontal size press 300 may be used to coat a paper web, indicated generally as 304, with a fire retardant composition (e.g., as described in FIG. 2 above). Web 304 moves in the direction indicated by arrow 306, and has a pair of opposed sides or surfaces, indicated, respectively, as 308 and 312.

Horizontal size press 300 includes a first source of wood ash fire retardant composition, indicated generally as nozzle 316, which is sprays a stream of the wood ash fire retardant composition, indicated by 320, generally downwardly towards the surface of a first transfer roll, indicated as 332, which rotates in a clockwise direction, as indicated by curved arrow 336. A flooded pond or puddle, indicated generally as 340, is created at the nip between first transfer roll 332 and second transfer roll 372 due to a bar or dam (not shown) positioned at below the nip. Transfer roll 332 transfers a relatively uniform and consistent thickness of a first coating of the wood ash fire retardant composition, indicated as 348, onto the first surface 308 of web 304.

A second source of fire retardant composition, indicated generally as nozzle 356, which is sprays a stream of the wood ash fire retardant composition, indicated by 360, generally downwardly towards the surface of a second transfer roll, indicated as 372, which rotates in a counterclockwise direction, as indicated by curved arrow 376. Transfer roll 372 transfers a relatively uniform and consistent thickness of a second coating of the wood ash fire retardant composition, indicated as 388, onto the second surface 312 of web 304.

Figure 4:
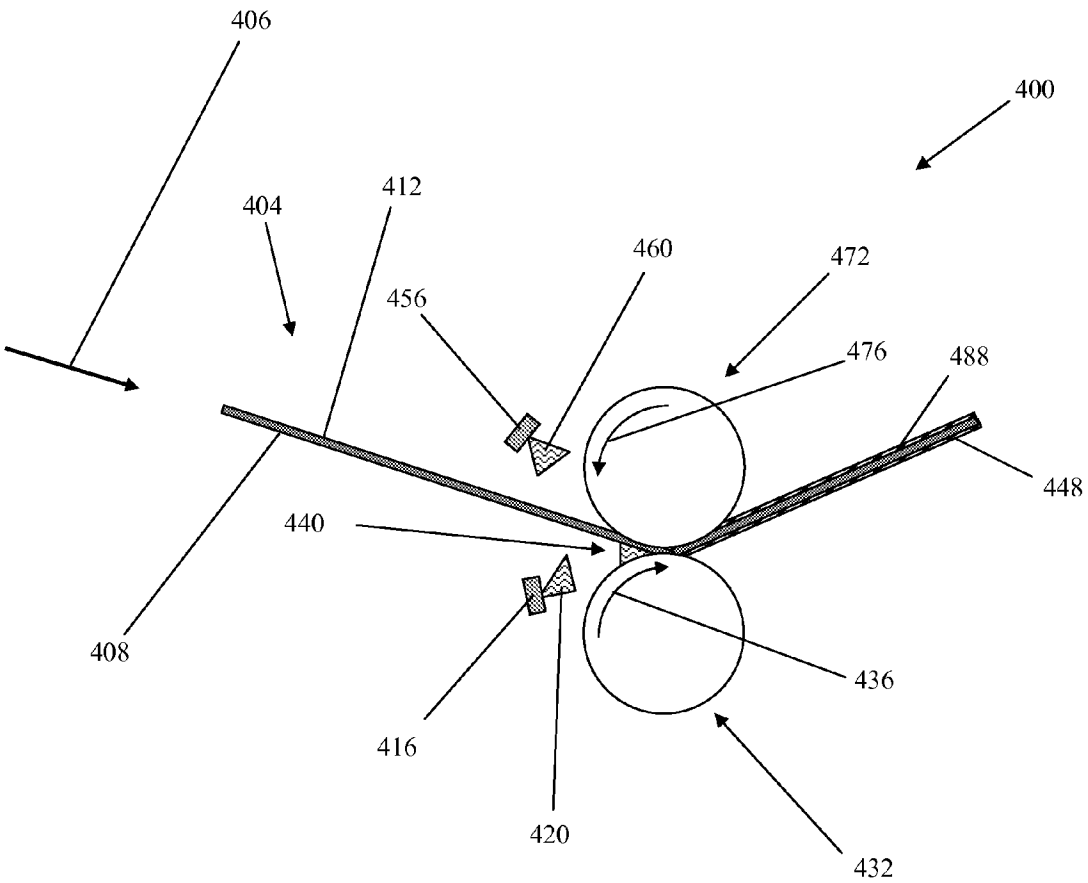
FIG. 4 a schematic diagram illustrating an embodiment of a process for treating one or both surfaces of a fibrous web with a wood ash fire retardant using a vertical flooded nip size press.

Referring to FIG. 4, another embodiment of a system for carrying out an embodiment of the process of the present invention is illustrated which may be in the form of, for example, a vertical flooded nip size press indicated generally as 400. Vertical size press 400 may be used to coat a paper web, indicated generally as 404, with a wood ash fire retardant composition (e.g., as described in FIG. 2 above). Web 404 moves in the direction indicated by arrow 406, and has a pair of opposed sides or surfaces, indicated, respectively, as 408 and 412.

Vertical size press 400 includes a first source of wood ash fire retardant composition, indicated generally as nozzle 416, which is sprays a stream of the fire retardant composition, indicated by 420, generally upwardly and towards the surface of a first lower transfer roll of the roll stack, indicated as 432, which rotates in a clockwise direction, as indicated by curved arrow 436. A smaller flooded pond or puddle, indicated generally as 440, (compared to the pond or puddle 440 of horizontal size press 400) is created at the nip between lower first transfer roll 432 and second upper transfer roll 472 due to a bar or dam (not shown) positioned to right of the nip. Transfer roll 432 transfers a relatively uniform and consistent thickness of a first coating of the wood ash fire retardant composition, indicated as 448, onto the lower first surface 408 of web 404.

A second source of wood ash fire retardant composition, indicated generally as nozzle 456, sprays a stream of the wood ash fire retardant composition, indicated by 460, generally downwardly and towards the surface of a second upper transfer roll, indicated as 472, which rotates in a counterclockwise direction, as indicated by curved arrow 476. Transfer roll 472 transfers a relatively uniform and consistent thickness of a second coating of the wood ash fire retardant composition, indicated as 488, onto the upper second surface 412 of web 404.

EXAMPLES

The properties, including fire resistance, of various insulation pulp fiber samples (IPFM), are shown in the Table below versus a Control sample:

| IPFM | % Fines[1] | Bag Weight (lbs)[2] | Shaken Density (g/g)[3] | Scan Density (g/cm$^3$)[4] | Burn Test (cm)[5] |
|---|---|---|---|---|---|
| Control | 41.4 | 28.2 | 1.58 | 0.076 | 36 |
| 36% SW | 26.4 | 22.8 | 1.29 | 0.049 | 120 |
| 60% SW | 26.8 | 21.0 | 1.22 | 0.051 | 120 |
| 80% SW | 26.6 | 20.5 | 1.00 | 0.048 | 120 |
| 100% HW | 35.1 | 26.0 | 1.48 | 0.066 | 39 |
| 100% HSW | — | — | — | — | 120 |

-continued

| IPFM | % Fines[1] | Bag Weight (lbs)[2] | Shaken Density (g/g)[3] | Scan Density (g/cm³)[4] | Burn Test (cm)[5] |
|---|---|---|---|---|---|
| 50% HSW-WA | 37.5 | 23.0 | 1.23 | 0.050 | 38 |
| 100% HSW-WA | 26.9 | 17.5 | 1.10 | 0.046 | 41 |

[1]Percentage passing through USA Std #200 screen (75 um hole opening)

[2]Scale weight of 50 ft.$^2$ standard cellulose insulation bag

[3]Measured by ASTM C687-07 test

[4]Veasured by SCAN-C 33:80 method

[5]Measured as cm of sample burned (starting sample ~120 cm in length) after carrying out ASTM E970-08A test. Sample passes burn test if less than 41 cm burned.

The Control sample is prepared entirely from old news papers (ONP). The 36% SW sample is prepared from 36% unrefined virgin softwood pulp fibers and 64% ONP. The 60% SW sample is prepared from 60% unrefined virgin softwood pulp fibers and 40% ONP. The 80% SW sample is prepared from 80% unrefined virgin softwood pulp fibers and 20% ONP. The 100% HW sample is prepared from 100% unrefined virgin hardwood. The 100% HSW sample is prepared from 100% of a mixture of unrefined virgin hardwood and softwood pulp fibers (75% hardwood and 25% softwood). The 50% HSW-WA sample is prepared from 50% of a mixture of unrefined virgin hardwood and softwood pulp fibers (75% hardwood and 25% softwood) and 50% ONP to which is added 6% wood ash fire retardant (based on the weight of the pulp fiber/ONP mixture). The 100% HSW-WA sample is prepared from 100% of a mixture of unrefined virgin hardwood and softwood pulp fibers (75% hardwood and 25% softwood) to which is also added 6% wood ash fire retardant (based on the weight of the pulp fiber mixture).

As shown by the above Table, as density of the insulation pulp fiber mixture decreases, the fire resistance of the mixture is also generally reduced (i.e., becomes less fire resistant). As also shown by the results from the 50% HSW-WA sample, as well as 100% HSW-WA sample, adding wood ash fire retardant increases (improves) the fire resistance of these insulation pulp fiber mixtures, relative to the 100% HSW to which no wood ash fire retardant is added.

All documents, patents, journal articles and other materials cited in the present application are hereby incorporated by reference.

Although the present invention has been fully described in conjunction with several embodiments thereof with reference to the accompanying drawings, it is to be understood that various changes and modifications may be apparent to those skilled in the art. Such changes and modifications are to be understood as included within the scope of the present invention as defined by the appended claims, unless they depart therefrom.

What is claimed is:

1. An article comprising a fire resistant cellulosic fiber thermal insulation material comprising:

a fibrous web providing an R-value (as measured by the ASTM C518 test) of at least about 3 and comprising:

from about 5 to about 85% unrefined virgin softwood pulp fibers by weight of the fibrous web; and from about 15 to about 85% unrefined virgin hardwood pulp fibers by weight of the fibrous web; and at least about 1.5% by weight of the fibrous web of a wood ash fire retardant component in and/or on the fibrous web and sufficient to impart at least partial fire resistance (as measured by the ASTM E970-08A test) to the fibrous web.

2. The article of claim 1, wherein the fibrous web comprises from about 10 to about 60% softwood pulp fibers and from about 40 to about 90% hardwood pulp fibers.

3. The article of claim 2, wherein the fibrous web comprises from about 15 to about 30% softwood fibers and from about 70 to about 85% hardwood fibers.

4. The article of claim 1, wherein the fibrous web provides an R-value in the range of from about 3 to about 4.5.

5. The article of claim 4, wherein the fibrous web provides an R-value in the range of from about 3.4 to about 4.2.

6. The article of claim 1, wherein the fibrous web has a basis weight about 850 gsm or less and a moisture content of less than about 20%.

7. The article of claim 6, wherein the fibrous web has a basis weight about 500 gsm or less and a moisture content of less than about 12%.

8. The article of claim 1, wherein the fibrous web includes one or more debonder surfactants in an amount (based on the fibrous web) of from about 0.05 to about 0.35% by weight.

9. The article of claim 8, wherein the fibrous web includes one or more debonder surfactants in an amount (based on the fibrous web) of from about 0.75 to about 0.15% by weight.

10. The article of claim 1, wherein the wood ash fire retardant component is present in and/or on the fibrous web in an amount of from about 1.5 to about 20%, by weight of the fibrous web.

11. The article of claim 10, wherein the wood ash fire retardant component is present in and/or on the fibrous web in an amount of from about 1.5 to about 5%, by weight of the fibrous web.

12. The article of claim 10, wherein the wood ash fire retardant component comprises one or more of: calcium carbonate; potash alum (potassium aluminum sulfate); sodium carbonate; clay; or talc.

13. The article claim 1, wherein the fibrous web includes one or more other fire retardants in an amount sufficient to pass the ASTM E970-08A test.

14. The article of claim 13, wherein the other fire retardants are one or more of: borate fire retardants, phosphorous fire retardants, halogenated fire retardants, or metal oxide fire retardants, and wherein the other fire retardants are present in and/or on the fibrous web in an amount (based on the fibrous web) of from about 15 to about 25% by weight.

15. The article of claim 14, wherein the other fire retardants are present in and/or on the fibrous web in an amount (based on the fibrous web) of from about 15 to about 18% by weight.

16. The article of claim 14, wherein the other fire retardants comprise one or more borate fire retardants.

17. A process for making the article of claim 1, comprising the following steps:

a. providing a fibrous web providing an R-value (as measured by the ASTM C518 test) of at least about 3 and comprising:

from about 5 to about 85% unrefined virgin softwood pulp fibers by weight of the fibrous web; and from about 15 to about 95% unrefined virgin hardwood pulp fibers by weight of the fibrous web; and b. treating the fibrous web with a wood ash fire composition comprising a wood ash fire retardant component such that the wood ash fire retardant component is present in and/or on the fibrous web in an amount of at least about 1.5%, by weight of the fibrous web and sufficient to provide a cellulosic fiber thermal insulation material which is at least partially fire resistant (as measured by the ASTM E970-08A test), to produce the article of claim 1.

18. The process of claim 17, wherein the fibrous web of step (a) is formed from a pulp slurry, and wherein step (b) is carried out by adding the wood ash fire retardant composition to a pulp slurry.

19. The process of claim 18, wherein step (b) is carried out by adding a portion of total wood ash fire retardant component to the pulp slurry, and by adding the remaining portion of the total wood ash fire retardant component to the formed fibrous web.

20. The process of claim 19, wherein step (b) is carried out by adding from about 5 to 100% of total wood ash fire retardant component to the pulp slurry, and by adding from 0 to about 95% of the total wood ash fire retardant component to the formed fibrous web.

21. The process of claim 20, wherein step (b) is carried out by adding from about 10 to about 90% of total wood ash fire retardant component to the pulp slurry, and by adding from about 10 to about 90% of the total wood ash fire retardant component to the formed fibrous web.

22. The process of claim 18, wherein step (b) is carried out by using a size press to add the remaining portion of the total wood ash fire retardant component to the formed fibrous web.

23. The process of claim 18, wherein step (b) is carried out by spraying the remaining portion of the total wood ash fire retardant component on the formed fibrous web.

24. The process of claim 17, wherein step (b) is carried out by treating the fibrous web with the wood ash fire retardant composition such that the wood ash fire retardant component is present in and/or on the fibrous web in an amount of from about 1.5 to about 20%, by weight of the fibrous web.

25. The process of claim 24, wherein step (b) is carried out by treating the fibrous web with the wood ash fire retardant composition such that the wood ash fire retardant component is present in and/or on the fibrous web in an amount of from about 1.5 to about 5%, by weight of the fibrous web.

26. The process of claim 25, wherein step (b) is carried out by treating the fibrous web with a wood ash fire retardant composition wherein the wood ash fire retardant component comprises one or more of: calcium carbonate; potash alum (potassium aluminum sulfate); sodium carbonate; clay; or talc.

27. The process of claim 17, which comprises the further following step: (c) treating the fibrous web with one or more other fire retardants in an amount sufficient to pass the ASTM E970-08A test.

28. The process of claim 27, wherein step (c) is carried by treating the fibrous web with one or more of: borate fire retardants, phosphorous fire retardants, halogenated fire retardants, or metal oxide fire retardants, in an amount (based on the fibrous web) of from about 15 to about 25% by weight.

29. The process of claim 28, wherein step (c) is carried by treating the fibrous web with one or more of: borate fire retardants, phosphorous fire retardants, halogenated fire retardants, or metal oxide fire retardants, in an amount (based on the fibrous web) of from about 15 to about 18% by weight.

30. The process of claim 28, wherein step (c) is carried by treating the fibrous web with one or more borate fire retardants.

31. The process of claim 17, wherein the fibrous web of step (a) comprises from about 10 to about 60% softwood pulp fibers and from about 40 to about 90% hardwood fibers.

32. The process of claim 31, wherein the fibrous web of step (a) comprises from about 15 to about 30% softwood pulp fibers and from about 70 to about 85% hardwood fibers.

33. The process of claim 17, which comprises the further following step: (d) treating the fibrous web with one or more debonder surfactants.

34. The process of claim 33, wherein step (d) is carried out by treating the fibrous web with the debonder surfactants in an amount (based on the fibrous web) of from about 0.05 to about 0.35% by weight.

35. The process of claim 34, wherein step (d) is carried out by treating the fibrous web with the debonder surfactants in an amount (based on the fibrous web) of from about 0.075 to about 0.15% by weight.

36. The process of claim 17, which comprises the further following step: (e) treating the fibrous web with one or more trivalent metal cations.

37. The process of claim 36, wherein step (e) is carried out by treating the fibrous web with alum.

* * * * *